US005704436A

United States Patent [19]

Smith et al.

[11] Patent Number: 5,704,436

[45] Date of Patent: Jan. 6, 1998

[54] METHOD OF REGULATING DRILLING CONDITIONS APPLIED TO A WELL BIT

[75] Inventors: Lee Morgan Smith; William A. Goldman, both of Houston, Tex.

[73] Assignee: Dresser Industries, Inc., Dallas, Tex.

[21] Appl. No.: 621,414

[22] Filed: Mar. 25, 1996

[51] Int. Cl.[6] ..... E21B 44/00

[52] U.S. Cl. ..... 175/27; 173/6

[58] Field of Search ..... 175/27, 24; 173/5, 173/6

[56] References Cited

U.S. PATENT DOCUMENTS

| | | | |
|---|---|---|---|
| 3,593,807 | 7/1971 | Klima | 173/6 |
| 3,971,449 | 7/1976 | Nylund et al. | 175/27 |
| 4,195,699 | 4/1980 | Rogers et al. | 175/27 |
| 4,354,233 | 10/1982 | Zhukovsky et al. | 175/27 X |
| 4,793,421 | 12/1988 | Jasinski | 175/27 |
| 4,875,530 | 10/1989 | Frink et al. | 175/27 |
| 4,914,591 | 4/1990 | Warren et al. | 364/422 |
| 5,415,030 | 5/1995 | Jogi et al. | 73/151 |
| 5,449,047 | 9/1995 | Schivley, Jr. | 175/27 |
| 5,458,207 | 10/1995 | Mattero | 175/27 |

FOREIGN PATENT DOCUMENTS

| | | | |
|---|---|---|---|
| 470593 | 8/1975 | U.S.S.R. | 175/27 |
| 726295 | 4/1980 | U.S.S.R. | 175/27 |
| 1716112 | 2/1992 | U.S.S.R. | 175/24 |

OTHER PUBLICATIONS

Howell Word and Marvin Fisbeck; Drilling Parameters and the Journal Bearing Carbide Bit pp. 92–93, *Drilling–DCW*, Jan. 1980, first published Oct., 1979 in Tulsa, Oklahoma.

Kenneth L. Mason; 3–Cone Bit Selection with Sonic Logs pp. 135–142, *SPE Drilling Engineering*, Jun. 1987, first published Sep. 1984 in Houston, TX.

E.M. Galle and H.B. Woods; Best Constant Weight and Rotary Speed for Rotary Rock Bits pp. 48–73, *API Drilling and Production Practice*, 1963.

R.C. Pessier, M.J. Fear; Quantifying Common Drilling Problems with Mechanical Specific Energy and a Bit–Specific Coeffecient of Sliding Friction pp. 373–388, *SPE Paper* 24584, published Oct. 1982, Washington, D.C.

T.M. Burgess, W.C. Lesso; Measuring the Wear of Milled Tooth Bits Using MWD Torque and Weight–on–Bit *SPE/IADC* 13475, pp. 453–458, for pages illustration, published Mar. 1985, New Orleans, Louisiana.

Allen D. Gault; Measurement of Drilling Properties pp. 143–148, *SPE Drilling Engineer*, Jun. 1987, published New Orleans, Louisiana (Mar. 1985).

*Primary Examiner*—Hoang C. Dang

*Attorney, Agent, or Firm*—Browning Bushman

[57] ABSTRACT

A method of regulating drilling conditions applied to a given well bit comprises assaying the compressive strength of the formation in an interval to be drilled by said bit. Wear of critical bit structure of the same size and design as in said given bit and which structure has drilled material of approximately the same compressive strength as that so assayed, is analyzed along with respective drilling data for the worn structure. From said analysis, a power limit for the respective compressive strength, above which power limit excessive wear is likely to occur is determined. Drilling conditions, such as rotary speed and weight-on-bit, at which the given bit is operated are regulated to maintain a desired operating power less than or equal to the power limit. Where several feasible rotary speed/weight-on-bit combinations may result in the desired operating power, these conditions are optimized.

20 Claims, 4 Drawing Sheets

METHOD OF REGULATING DRILLING CONDITIONS APPLIED TO A WELL BIT

CROSS REFERENCE TO RELATED APPLICATIONS

This application is related to copending U.S. patent application Ser. No. 08/621,412 entitled *METHOD OF ASSAYING COMPRESSIVE STRENGTH OF ROCK* and U.S. patent application Ser. No. 08/621,411 entitled *METHOD OF ASSAYING DOWNHOLE OCCURRENCES AND CONDITIONS*, both of such applications being filed contemporaneously with the present application and naming the same inventors as named in the present application.

BACKGROUND OF THE INVENTION

The present invention pertains to the regulation, and preferably optimization, of drilling conditions, specifically rotary speed and weight-on-bit, applied to a well bit. As used herein, the term "well bit" includes ordinary well drilling bits, as well as coring bits.

In the past, the regulation of such drilling conditions has often been more a matter of art (or even guess work) than science.

To the present inventor's knowledge, there have been at least a few efforts to take a more scientific approach to such regulation. For example, U.S. Pat. No. 5,449,047 discloses "automatic" control of a drilling system. The basic approach is simply to empirically maintain a given depth of cut (per revolution) for a given range of rock compressive strengths.

"Best Constant Weight and Rotary Speed for Rotary Rock Bits," by E. M. Galle and H. B. Woods, *API Drilling and Production Practice*, 1963, pages 48–73, describes a method which operates on the assumption that, in any given drilling operation, if the weight-on-bit changes, the rotary speed will automatically change accordingly (and/or vice-versa) such that the product of weight-on-bit and rotary speed will remain constant throughout the drilling operation. (The present inventors have found that, although a change in one of these variables may cause a responsive change in the other, the assumption that the product of the two always remains constant is invalid.) Proceeding on this assumption, the method involves the use of laboratory tests to find weight-on-bit and rotary speed combinations which result in bit failure, and avoid those combinations. Another technical paper, "Drilling Parameters and the Journal Bearing Bit," by H. Word and M. Fisbeck, presented at the 34th Annual Petroleum Mechanical Engineering Conference, Tulsa, Okla., 1979, updates the last-mentioned paper, but does not change the basic assumption and methodology.

None of the above methods optimize the overall drilling operation as well as they might.

SUMMARY OF THE INVENTION

The present invention appears to provide a more universally valid criterion for avoiding at least catastrophic bit wear, and in preferred embodiments of the invention, also avoiding unacceptably accelerated bit wear rates, so that a balance may be achieved between bit life and other parameters, such as penetration rate. Although the drilling conditions ultimately regulated are preferably rotary speed and weight-on-bit, the aforementioned criterion is neither one, the other, nor both of these parameters per se, but rather, is power. By using power as the basic criterion, it is possible, in preferred forms of the invention, to provide a selection of rotary speed and weight-on-bit combinations which will achieve the desired power, and then use still other criteria for optimizing within this range.

In the most basic form of the present invention, the compressive strength of the formation in an interval to be drilled by the bit is assayed. Critical bit structure of the same size and design as in the given bit, and which structure has drilled material of approximately the same compressive strength as that so assayed, along with respective drilling data for the worn structure is analyzed. From this analysis, a power limit for the respective compressive strength is determined. Above this power limit, undesirable bit wear is likely to occur. In very basic forms of the present invention, "undesirable" bit wear may be chosen to be catastrophic bit failure. However, in more highly preferred embodiments, unduly accelerated wear rates are considered undesirable, and avoided by use of the power limit.

In any case, this is done by regulating the drilling conditions at which the given bit is operated to maintain a desired operating power less than or equal to the power limit.

The "critical structure" so analyzed is defined as that structure which, in the given bit design, will in all likelihood wear most rapidly and/or first fail, so that this structure is the limiting factor on bit life. For example, in polycrystaline diamond compact ("PDC") type drag bits, the cutters or polycrystaline diamond compacts will usually be the critical structure. On the other hand, in roller cone type bits, the critical structure is typically the bearing or journal structure.

In preferred embodiments of the invention, a plurality of such structures, and their respective drilling data, are so analyzed. From those analyses, a first type series of correlated pairs of electrical signals are generated. The two signals of each such pair correspond, respectively, to wear rate and operating power for a respective one of the structures. The power limit is generated from these signals of the first type series. An advantage of analyzing multiple critical structures and generating such a series of correlated pairs of signals is a much higher degree of certainty in determining a power limit above which excessively accelerated wear (as opposed to total failure) occurs. Thus, these preferred embodiments can do more than simply avoid catastrophic bit wear, they can balance a reasonable wear rate (and thus balance bit life) against other factors such as penetration rate.

"Corresponding," as used herein, with respect to signals or numerical values, will mean "functionally related," and it will be understood that the function in question could, but need not, be a simple equivalency relationship. "Corresponding precisely to," if used with respect to an electrical signal, will mean that the signal translates directly to the value of the very parameter in question. "Wear rate" of a bit part may be defined either in units of length (measured from the outer profile of the new part) per unit time or volume of material (of the part) per unit time.

The drilling conditions regulated are preferably rotary speed and weight-on-bit. In general, it is preferable to build in a safety factor, i.e. to maintain the power level somewhat less than the power limit, but about as close to the limit as reasonably possible. Thus, for example, "reasonably" includes the use of the aforementioned safety factor, as well as adjustment for various pragmatic limitations on the drilling conditions to be regulated. By way of more specific example, a given rig may have a limit on rotary speed which does not permit operation as close to the power limit as might, theoretically, be desired, even considering the safety factor. Likewise, in a hole which is not yet very deep, it may be a practical impossibility to apply enough weight-on-bit to operate as close to the power limit as theoretically desirable.

Preferred embodiments of the invention further comprise generating a second type series of correlated pairs of electrical signals, the respective signals of each pair corresponding to a rotary speed value and a weight-on-bit value, and wherein the rotary speed and weight-on-bit values of each pair theoretically result in a power corresponding to the power limit. In other words, even for a constant rock strength and wear condition of the bit, there are a number of different combinations of rotary speed and weight-on-bit which can theoretically result in a power at the aforementioned limit. The bit is preferably operated at a rotary speed and weight-on-bit corresponding to one of the pairs of signals in this second series. Recalling that "corresponding to" means functionally related to, it should be understood that this will could mean that the bit may be operated at rotary speed and weight-on-bit values slightly less than those corresponding precisely to one of the pairs of signals, whereby a safety factor is included, e.g. because some bit vibrations almost always occur.

It is also possible to determine a rotary speed limit for the power limit, above which substantially disadvantageous bit movement characteristics, such as peak axial and lateral vibrations and bit whirl, are likely to occur. Thus, even though operating above this speed limit may result in the desired power, it is preferable to operate the bit below this rotary speed limit. Likewise, it is possible to determine a weight-on-bit limit for the power limit above which other types of highly disadvantageous bit movement characteristics, such as peak torsional vibrations and so-called "stick slip" are likely to occur, and it is likewise desirable to operate the bit at a weight-on-bit below this latter limit.

In preferred embodiments, a marginal rotary speed for the power limit, which marginal rotary speed is less than the aforementioned rotary speed limit, is determined, above which undesirable bit movement characteristics, such as increasing axial and lateral vibrations, are likely to occur. It is likewise preferable to determine a marginal weight-on-bit for the power limit, less than the aforementioned weight-on-bit limit, above which other types of undesirable bit movement characteristics, such as increasing torsional vibrations, are likely to occur. Clearly, it will be even more preferable to operate the bit at a rotary speed less than or equal to the marginal rotary speed, and at a weight-on-bit less than or equal to the marginal weight-on-bit.

It is even further preferable to operate about as close as possible to an optimum rotary speed and weight-on-bit combination as close as reasonably possible to the marginal weight-on-bit.

It is also preferable to generate a plurality of such second series of signals, each series corresponding to a different degree of bit wear, but for the same rock strength. Then, by modeling or monitoring bit wear and using these other second type series, it is preferable to increase the weight-on-bit and correspondingly alter the rotary speed as the bit wears. Likewise, it will often be anticipated that the bit in question will be drilling through a plurality of formation layers or strata of different compressive strengths. In such instances, it is preferable to generate respective such first and second type series of signals for each such compressive strength, monitor the progress of the bit through the formation, and periodically alter the operation of the bit in accord with the respective series of signals for the compressive strength of the formation currently being drilled by the bit.

Further details of the present invention and ways of implementing it, along with various salient features, objects and advantages thereof, will be made apparent by the following detailed description, along with the drawings and claims.

DETAILED DESCRIPTION

Figure 1:
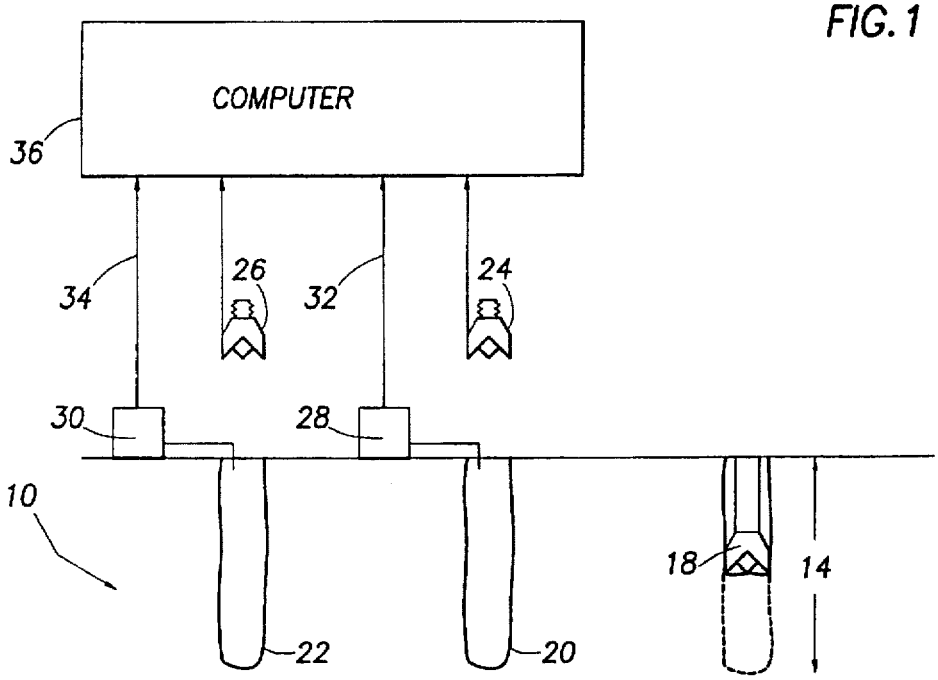
FIG. 1 is a diagrammatic illustration of drilling operations from which input data can be generated and to which the invention can be applied, as related to a computer.

FIG. 1 illustrates an earth formation 10. It is intended that a given well bit 18 drill an interval 14 of the formation 10 generally corresponding to bore hole intervals 20 and 22, which have been drilled by bits 24 and 26, of the same size and design as bit 18.

Before bit 18 is even started into its respective hole (as shown), the compressive strength of the formation interval desired to be drilled by bit 18 will have been assayed. This can conveniently be done, in a manner known in the art, by analyzing drilling data, such as well logs, discharged cuttings analyses, and core analyses, diagrammatically indicated at 28 and 30, from the nearby hole intervals 20 and 22. For this part of the description, we will assume a very simple case in which the assay indicates a constant compressive strength over the entire interval 14.

Figure 2:
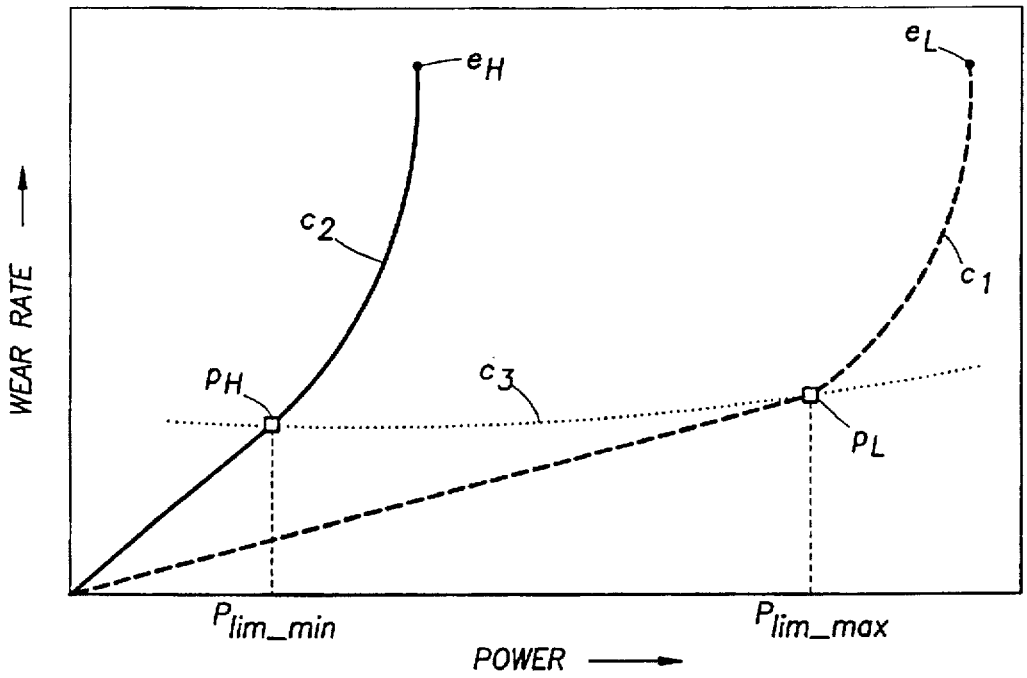
FIG. 2 is a graphic illustration of power limits.

Next, a power limit is generated. Referring to FIG. 2, the present inventors' research has shown that, as operating power is increased, the wear rate of any given bit tends to follow a fairly predictable pattern. Curve $c_1$ illustrates this pattern for a relatively soft rock, i.e. a rock of relatively low compressive strength. It can be seen that the wear rate increases approximately linearly with increases in power up to a point $p_L$. With further increases in power, the wear rate begins to increase more rapidly, more specifically, exponentially. These severe wear rates are due to increasing frictional forces, elevated temperature, and increasing vibration intensity (impulse loading). Finally, the wear rate reaches an end point $e_L$, which represents catastrophic bit failure. This catastrophic wear would occur at the power at this end point under steady state conditions in actual field drilling, but could occur at a lower power, i.e. somewhere between $p_L$ and $e_L$, under high impact loading due to excessive vibrations. The curve $c_2$ is a similar curve for a rock of relatively high compressive strength. Again, the wear rate increases approximately linearly with increase in power (albeit at a greater rate as indicated by the slope of the curve $c_2$, up to a point $p_H$, after which the wear rate begins to increase more rapidly until catastrophic failure is reached at point $e_H$.

In order to generate an appropriate power limit, critical structure of the same type as in the bit 18 is analyzed. In less preferred embodiments of the invention, such analysis could, for example, consists of running a single polycrystaline diamond compact, mounted on a suitable support, against material of approximately the same compressive strength as that assayed for formation interval 14, in a laboratory, gradually increasing the operating power, until failure is observed. However, this failure could be anomalous, e.g. a function of some peculiarity of the particular cutter so analyzed, and in any event, would only give a power value for catastrophic failure, such as at point $e_H$ or $e_L$. In the present invention, it is preferable to avoid not only such catastrophic failure, but also to avoid operating at power levels which produce the exponentially increasing wear rates exemplified by the portions of the curves between points $p_H$ and $e_H$, and between points $p_L$ and $e_L$.

Therefore, in the preferred embodiments, a plurality of critical structures of the same size and design as in bit 18, and which structures have drilled material of approximately the same compressive strength as that so assayed, along with respective drilling data are analyzed. Some of these structures may be separate bit parts or subassemblies, especially if the bit 18 is of the PDC drag type wherein the critical structures are the cutters, worn and analyzed under laboratory conditions. However, it is helpful if at least some of the structures so analyzed be incorporated in complete bits which are worn in field drilling. For example, these could include bits 24 and 26 from holes 20 and 22, which would be analyzed along with their respective drilling data 32 and 34. These latter bits and respective drilling data may also provide data for further aspects of the invention, to be described below.

In any event, from the data from the critical structures so analyzed, corresponding electrical signals are generated and processed in a computer 36 to generate a first type series of correlated pairs of electrical signals.

Before elaborating on this first type series of correlated pairs of electrical signals, it is noted that, for the sake of simplicity and clarity of FIG. 1, only two worn bits and their respective holes and drilling data are illustrated. However, in preferred embodiments, the first type series of signals would be generated from a greater number of worn bits and their respective drilling data. These could come from the same formation 10 or from other fields having formations of comparable compressive strengths and/or multiple lab tests.

In the first type series of correlated pairs of electrical signals, the two signals of each such pair correspond, respectively, to wear rate and operating power for the respective worn bit.

FIG. 2 is a mathematical, specifically graphical, illustration of the relationships between these signals. The curve $c_1$ represents the aforementioned series of the first type for rock of a relatively low compressive strength. By processing the series of signals corresponding to the curve $c_1$, it is possible for computer 36 to generate an electrical power limit signal corresponding to a power limit, e.g. the power value at point $p_L$, for the low compressive strength in question, above which power limit excessive wear is likely to occur.

A second series of correlated pairs of signals of the first type is likewise generated for a relatively high compressive strength, and a graphic illustration of the relationship between these signals is illustrated by curve $c_2$. Again, from these signals, an electrical power limit signal can be generated, which signal corresponds to a power limit at critical point $p_H$, where wear rate stops increasing linearly with increase in power, and begins to increase exponentially.

In accord with preferred embodiments of the present invention, additional series of the first type, comprising correlated pairs of signals, would be generated for intermediate compressive strengths. From the signals of each such series, a power limit signal for the respective compressive strength would be generated. These other series are not graphically illustrated in FIG. 2, for simplicity and clarity of the illustration. It would be seen that, if they were illustrated, points such as $p_L$ and $p_H$ chosen as the power limits, and the power limit points of all curves connected, the connections would result in the curve $c_3$, which would give power limits for virtually all compressive strengths in a desired range. It will be appreciated that computer 36 can be made to process the signals in these various series to result in another type of series of signals corresponding to curve $c_3$. Assuming the curve $c_1$ is for the lowest compressive strength in the desired range, and the curve $c_2$ for the highest, then the values $p_{Lim\text{-}min}$ and $p_{Lim\text{-}max}$ represent the power limits of a range of feasible powers for the bit design in question. It is noted that the curve $c_3$ could theoretically be viewed as also a function of cutter (or tooth) metallurgy and diamond quality, but these factors are negligible, as a practical matter.

A most basic aspect of the present invention includes regulating drilling conditions at which the given bit 18 is operated to maintain a desired operating power level less than or equal to the power limit for the compressive strength assayed for the rock currently being drilled by that bit. Preferably, the power limit chosen is a point such as $p_L$, where wear rate begins to increase exponentially. However, in less preferred embodiments, it could be higher. Thus, when drilling through the softest rock in the range, the conditions are regulated to keep the power at or below the power $p_{Lim\text{-}max}$. Preferably, the power is kept less than the power limit, to provide a safety factor. However, it is desirable that the power be maintained about as close as reasonably possible to the power limit. "As close as reasonably possible" is meant to allow for not only the aforementioned safety factor, but also for practical limitations, e.g. limitations of the drilling rig being used such as torque limit, flow rate limit, etc. This expression is modified by "about" because the spirit of this aspect of preferred forms of the invention is meant to include workable variations, the maximum values of which may vary, e.g. with cost of operating time or a given operator's assessment of an appropriate safety factor.

Operating as close as reasonably possible to the power limit maximizes the rate of penetration, which is directly proportional to power. In general, it is desirable to maximize penetration rate, except in extreme cases wherein one might begin drilling so fast that the quantity of cuttings generated would increase the effective mud weight to the point where it could exceed the fracture gradient for the formation.

The drilling conditions so regulated include conditions applied to the bit, specifically rotary speed and weight-on-bit. Bit vibrations, which can be detected while drilling through known means, may cause the forces transmitted to the formation by the bit to vary over small increments of the interval being drilled or to be drilled. In such instances, it is preferable that the applied conditions be regulated with reference to the peak transmitted forces among these fluctuations, rather than, say, the mean transmitted forces.

In accord with another aspect of preferred forms of the invention, there are a number of combinations of rotary speed and weight-on-bit, any one of which will result in a power corresponding to the power limit. The invention includes a method of optimizing the particular combination chosen.

Figure 3:
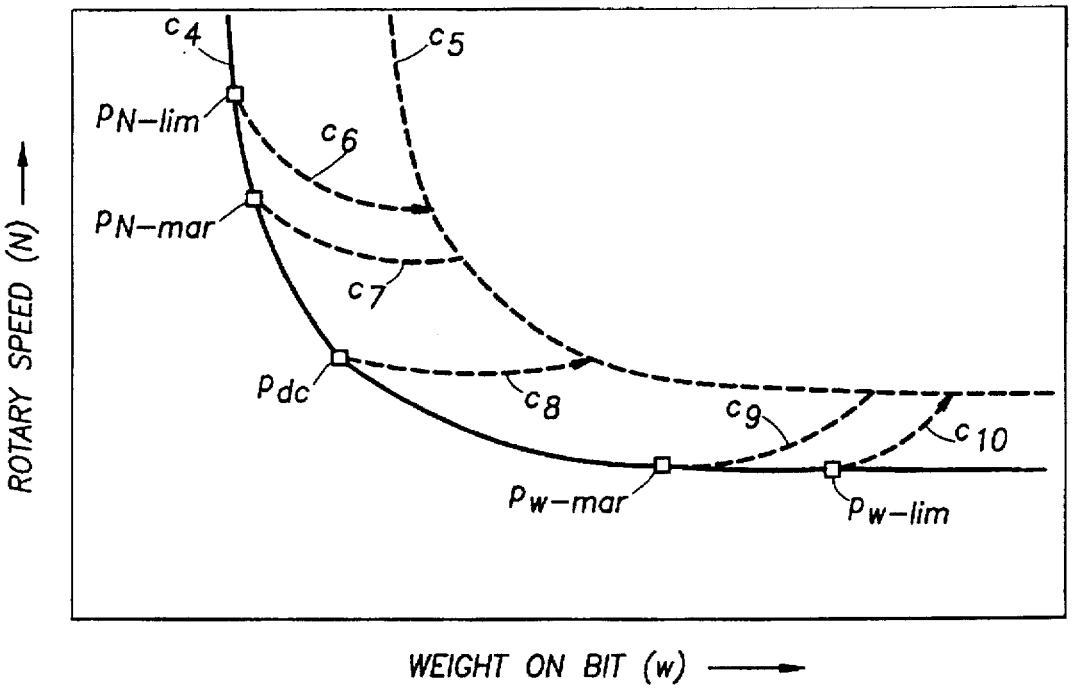
FIG. 3 is a graphic illustration of second type signal series for relatively soft rock.

FIG. 3 includes a curve $c_4$ representing values corresponding to paired signals in a series of a second type for a new bit of the design in question. The signal series corresponding to curve $c_4$ is generated, in a manner described more fully below, from historical data from a number of bits of the same size and design as bit 18, and which have drilled formation of approximately the same compressive strength as that assayed for the interval 14. A curve such as $c_4$ may result from plotting the rotary speed values against the weight-on-bit values from the individual historical data and then extrapolating a continuous curve. It will be appreciated that those of skill in the art could program computer 36 to perform equivalent operations on correlated pairs of electrical signals corresponding, respectively, to the rotary speed and weight-on-bit values of the historical data, and that the computer 36 could even produce a graphical representation such as curve $c_4$. The historical data would be used to generate corresponding electrical signals inputted into the computer 36, which then further generates sufficient additional such pairs of signals, consistent with the pattern from the original inputs, to provide a second type series of correlated pairs of weight-on-bit and rotary speed signals. From this second series, the graphical representation $c_4$ can be extrapolated, indeed generated by computer 36.

Correlating the curve $c_4$ (and/or the corresponding series of signals) with the historical drilling data (or corresponding signals), it is possible to determine a point $p_{N\text{-}mar}$ at which the rotary speed value, N, is at a marginal desirable value, i.e. a value above which undesirable bit movement characteristics are likely to occur, specifically the inevitable lateral and/or axial vibrations begin to increase, either because the rotary speed is too high and/or the corresponding weight-on-bit is too low. At another point $p_{N\text{-}Lim}$, at which the rotary speed is even higher, these undesirable bit movement characteristics, specifically axial and/or lateral vibrations, peak, e.g. resulting in bit whirl; thus it is even less desirable to operate near or above the rotary speed at $p_{N\text{-}Lim}$. The weight-on-bit at $p_{N\text{-}Lim}$ is the minimum weight-on-bit needed to dampen such vibrations and is sometimes referred to herein as the "threshold" weight-on-bit.

Likewise, it is possible to locate a point $p_{w\text{-}mar}$ at which the weight-on-bit, w, is at a marginal desirable value in that, above this value, other kinds of undesirable bit movement characteristics, specifically increasing torsional vibrations, occur. At $p_{w\text{-}Lim}$ these undesirable movements peak and "stick-slip" (jerky rather than continuous bit rotation) may occur, so it is even less desirable to operate with weights near or above the weight-on-bit value at $p_{N\text{-}Lim}$.

In general, although any point on the curve $c_4$ includes a rotary speed and weight-on-bit value corresponding to the power limit for the compressive strength in question and for a new bit, it will clearly be desirable to operate within the range between points $p_{N\text{-}mar}$ and $p_{N\text{-}mar}$. As illustrated, the curve $c_4$ corresponds precisely to the power limit. Therefore, to include the aforementioned safety feature, it would be even more preferable to operate in a range short of either of the points $p_{N\text{-}mar}$ or $p_{w\text{-}mar}$. Even more preferably, one should operate at values corresponding to a point on the curve $c_4$ at which the weight-on-bit value, w, is less than, but about as close as reasonably possible to the weight-on-bit value at $p_{w\text{-}mar}$. This is because, the higher the rotary speed, the more energy is available for potential vibration of the drill string (as opposed to just the bit per se).

Bearing in mind that FIG. 3 pertains to relatively soft rock, it will be seen that, about as close as reasonably possible to $p_{w\text{-}mar}$ will, in this case, actually be rather far from $p_{w\text{-}mar}$. This is because, in very soft rock, the bit will reach a maximum depth of cut, wherein the cutting structures of the bit are fully embedded in the rock, at a weight-on-bit value at point $p_{dc}$, which is well below the weight-on-bit value at $p_{W\text{-}mar}$. For PDC and roller cone bits, it is unreasonable, and useless, to apply additional weight on the bit beyond that which fully embeds the cutters. For diamond impregnated bits, it may be desirable to operate at a weight-on-bit somewhat greater than that at $p_{dc}$. This partially embeds the matrix bit body, into which the diamonds are impregnated. Thus the matrix wears along with the diamonds so that the diamonds always protrude somewhat from the matrix (a condition sometimes called "self-sharpening "). Therefore, the optimum rotary speed and weight-on-bit values will be those at or near point $p_{dc}$.

From additional historical drilling data, another series of correlated signals of the second type can be generated for a badly worn bit of the type in question, and these correspond to the curve $c_5$. Intermediate series of this second type, for lesser degrees of wear, could also be generated, but are not illustrated by curves in FIG. 3 for simplicity and clarity of illustration. In any event, the computer 36 can be made to process the signals of these various series, in a manner well known in the art, so as to generate series of signals of a third type corresponding to curves $c_6$, $c_7$, $c_8$, $c_9$, and $c_{10}$. Curve $c_6$ corresponds to $p_{N\text{-}Lim}$ type values, as they vary with wear. Curve $c_7$ corresponds to $p_{N\text{-}mar}$ type values as they vary with bit wear. Curve $c_8$ corresponds to $p_{dc}$ type values as they vary with bit wear. Curve $c_9$ corresponds to $p_{w\text{-}mar}$ type values as they vary with bit wear. And curve $c_{10}$ corresponds to $p_{w\text{-}Lim}$ type values as they vary with wear. Thus, as drilling proceeds, it is desirable to measure and/or model the wear of bit 18, and periodically increase the weight-on-bit, and correspondingly alter the rotary speed, preferably staying within the range between curves $c_6$ and $c_{10}$, more preferably between curve $c_7$ and curve $c_9$, and even more preferably at or near curve $c_8$.

Figure 4:
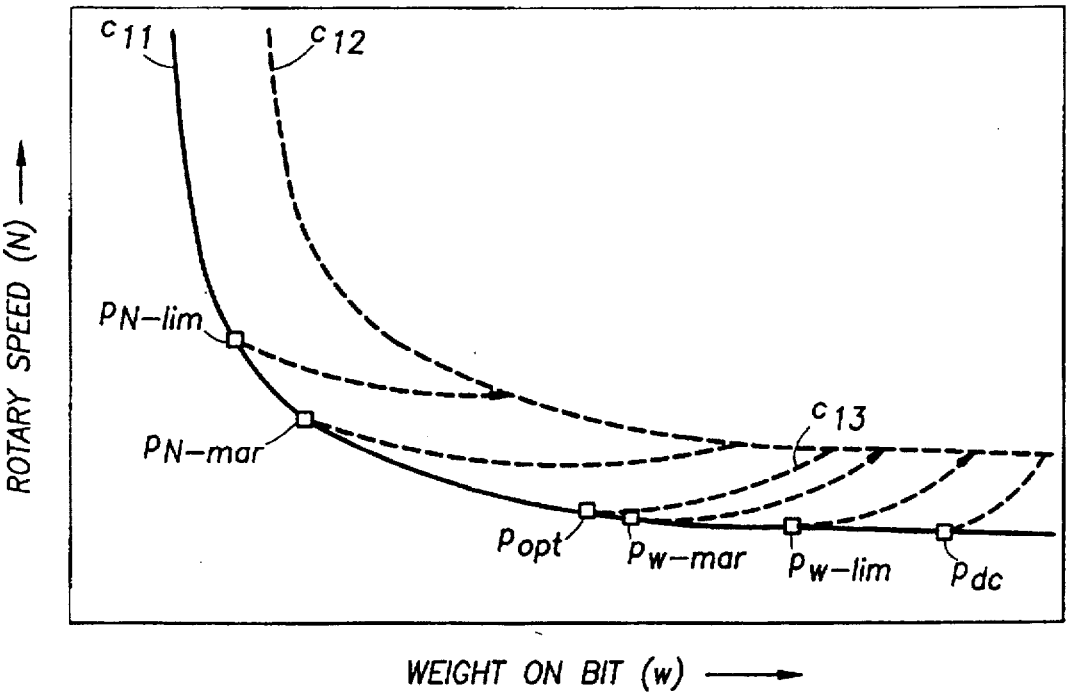
FIG. 4 is a graphic illustration similar to that of FIG. 3, but for relatively hard rock.

FIG. 4 is similar to FIG. 3, but represents series of signals for a relatively hard (high compressive strength) rock. Here, again, there are shown two curves $c_{11}$ and $c_{12}$ corresponding, respectively, to series of signals of the second type for a new and badly worn bit. In this hard rock, the point $p_{w\text{-}mar}$ whereafter further increases in weight-on-bit will result in undesirable torsional vibrations, has a weight-on-bit value less than that of point $p_{dc}$ and so, therefore does $p_{w\text{-}Lim}$. Thus, in hard rock, even allowing for a safety factor, it will be possible to operate at an optimum pair of values, occurring at $p_{opt}$ much closer to $p_{w\text{-}mar}$, than is the case for soft rock. Other pairs of values, analogous to $p_{opt}$, can be found for varying degrees of bit wear. From the signals corresponding to these, a series of paired electrical signals can be generated and corresponding curve $c_{13}$ extrapolated by computer 36.

As before, "as close as reasonably possible" is meant to allow for not only a safety factor, but also for practical limitations. For example, a theoretically optimum pair of rotary speed, weight-on-bit values might, in the context of a particular drill string geometry or hole geometry, produce drill string resonance, which should be avoided.

In other highly unusual examples, the rock may be so hard, and the torque capability of the motor so low, that the rig is incapable of applying enough weight-on-bit to even reach the threshold weight-on-bit value at $p_{N\text{-}Lim}$. Then it is impossible to even stay within the range between $p_{N\text{-}Lim}$ and $p_{w\text{-}Lim}$. Then one would operate about as close as reasonably possible to this range, e.g. at a weight-on-bit less than that at $p_{N\text{-}Lim}$ and a correspondingly high rotary speed.

It should also be borne in mind that, while values such as those shown on the various curves in FIGS. 3 and 4 are generally valid, aberrant conditions in a particular drilling operation may cause undesirable bit and/or drill string movements at rotary speed and weight-on-bit values at which they should not, theoretically, occur. Thus it is desirable to provide means, known in the art, to detect such movements in real time (while drilling) and take appropriate corrective action whenever such movements are detected, staying as close to the optimum values as possible while still correcting the condition.

With the above general concepts in mind, there will now be described one exemplary method of processing signals to obtain series of signals of the type corresponding to the curves in FIGS. 3 and 4.

For the rock strength $\sigma$ in question, historical empirical wear and power data are used to generate corresponding electrical signals, and those signals are processed by computer 36 to generate a series of paired signals of the first type, corresponding to a limiting power curve such as $c_1$ or $c_2$.

Next, from historical empirical data, e.g. logs from holes 20 and 22 showing torque and vibration measurements, limiting torque values may be determined. Specifically a torque value $T_{N\text{-}Lim}$ at which lateral and axial vibrations peak, i.e. a value corresponding $p_{N\text{-}Lim}$ for the $\sigma$ and wear condition in question. and a torque value $T_{w\text{-}Lim}$ at which torsional vibrations peak (produce "stick slip"), i.e. a value corresponding to $p_{Lim}$ for the $\sigma$ and the wear condition in question, are determined. Preferably, torque values $T_{N\text{-}mar}$ and $T_{w\text{-}mar}$ corresponding, respectively, to $p_{N\text{-}mar}$ and $p_{w\text{-}mar}$ for the $\sigma$ and wear condition in question are likewise determined.

Preferably, there are plentiful torque and vibration data for the $\sigma$ and wear condition in question. These are converted to corresponding electrical signals inputted into computer 36. These signals are processed by computer 36 to produce signals corresponding to the torque values $T_{N\text{-}Lim}$, $T_{N\text{-}mar}$, $T_{w\text{-}mar}$ and $T_{w\text{-}Lim}$.

At least if $\sigma$ is low, i.e. the rock is soft, and preferably in any case, a torque value $T_{dc}$, corresponding to the torque at which the maximum depth of cut is reached (i.e. the cutting structure is fully embedded) is also determined. It will be seen that this value and its corresponding electrical signal also correspond to $p_{dc}$.

The data for determining $T_{dc}$ can be provided by laboratory tests. Alternatively, in an actual drilling operation in the field, $T_{dc}$ can be determined by beginning to drill at a fixed rotary speed and minimal weight-on-bit, then gradually increasing the weight-on-bit while monitoring torque and penetration rate. Penetration rate will increase with weight-on-bit to a point at which it will level off, or even drop. The torque at that point is $T_{dc}$.

For each of the aforementioned torque values, it is possible to process the corresponding electrical signal to produce signals corresponding to corresponding rotary speed and weight-on-bit values, and thus to locate a corresponding point on a curve such as those shown in FIGS. 3 and 4.

A value w, the weight-on-bit corresponding to the torque, T, in question can be determined and a corresponding signal generated and inputted into computer 36.

Alternatively, where signal series or families of series are being developed to provide complete advance guidelines for a particular bit, it may be helpful to define, from field data, a value, $\mu$, which varies with wear:

$$\mu = \frac{T - T_o}{w - w_o} \tag{1}$$

where $T_o$=torque for threshold weight-on-bit $W_o$=threshold weight-on-bit

Then computer 36 processes the T, $T_o$, $w_o$ and $\mu$ signals to perform the electronic equivalent of solving the equation:

$$w = \frac{T - T_o}{\mu} + w_o \tag{2}$$

to produce a signal corresponding to the weight-on-bit corresponding to the torque in question.

Next, computer 36 performs the electronic equivalent of solving the equation:

$$N = P_{lim}/(2\pi\mu + d_c)w60 \tag{3}$$

or $$N = P_{lim}/\left(2\pi + \frac{d_c}{\mu}\right)T60 \tag{3a}$$

where

N=rotary speed $p_{Lim}$=the power limit previously determined as described above $d_c$=penetration per revolution (or "depth of cut")

where it is desired to use both axial and torsional components (the lateral component being negligible). Alternatively, if it is desired to use the torsional component only, these equations become:

$$N=P_{Lim}/120\pi\mu w \tag{4}$$

or $$N=P_{Lim}/120\pi T \tag{4a}$$

The computer does this by processing signals corresponding to the variables and constants in equation (3), (3*a*), (4) or (4*a*).

We now have signals corresponding, respectively, to a weight-on-bit, w, and a rotary speed, N, corresponding to the torque, T, in question, i.e. a first pair of signals for a series of the second type represented by curves $c_4$, $c_5$, $c_{11}$, and $c_{12}$. For example, if the torque used was $T_{Lim}$, we can locate point $p_{N\text{-}Lim}$.

By similarly processing additional torque signals for the same bit wear condition and rock strength, $\sigma$, we can develop the entire second type series of pairs, corresponding to a curve such as $c_4$, including all the reference points $p_{N\text{-}Lim}$, $p_{N\text{-}mar}$, $p_{dc}$, $p_{w\text{-}mar}$ and $p_{w\text{-}Lim}$.

Then, when drilling with a bit of the size, design and wear condition in question, in rock of the strength $\sigma$ in question, one operates at a rotary speed, weight-on-bit combination corresponding to a pair of signals in this series, in the range between $p_{N\text{-}Lim}$ and $p_{w\text{-}Lim}$, unless w at $p_{w\text{-}Lim}$>w at $p_{dc}$, in which case one operates at values between $P_{N\text{-}Lim}$ and $p_{dc}$.

More preferably, one operates between $p_{N\text{-}mar}$ and $p_{w\text{-}mar}$, or $p_{N\text{-}mar}$ and $p_{dc}$, whichever gives the smaller range. Even more preferably one operates about as close as reasonably possible to $p_{dc}$ or $p_{w\text{-}mar}$, whichever has the lower weight-on-bit. If $p_{dc}$ has the lower weight-on-bit, and the bit is of the PDC or roller cone type, one operates at or slightly below the values at $p_{dc}$, depending on the safety factor desired. However, if the bit is of the diamond impreg type, one might prefer to operate at or slightly above $p_{dc}$.

By similar processing of signals for the same rock strength, $\sigma$, but different wear conditions, one can develop a family of series of paired signals of the second type, which can be depicted as a family of curves or a region, such as the region between curves $c_{11}$ and $c_2$.

It is then possible to develop series of the third type, corresponding, for example, to curves $c_8$ and $c_{13}$. Then, by monitoring or modeling the wear of the bit, one can optimize by increasing the weight-on-bit, w, applied as the bit wears and correspondingly adjusting the rotary speed, N.

In less preferred embodiments, one may simply select a torque $T_{opt}$, e.g. as close as reasonably possible to $T_{dc}$ or $T_{w\text{-}mar}$, whichever is less, then process as explained above to obtain the corresponding w and N. Repeating this for different wear conditions, one can simply generate a series of the third type, e.g. corresponding to curve $c_{13}$.

However, it is preferable to develop ranges, as shown in FIGS. 3 and 4 to provide guidelines for modification of the hypothetical optimum operating conditions. For example, if operating at $p_{opt}$ with a particular string and hole geometry should produce resonance in the string, the operator can then select another set of conditions between $p_{N\text{-}mar}$ and $p_{w\text{-}mar}$.

It will be understood by those of skill in the art that many alternate ways of generating and processing data to generate the signal series are possible, the above being exemplary.

As mentioned above, up to this point, we have assumed $\sigma$ is constant over interval 14. However, in actual drilling operations, $\sigma$ may vary over the interval drilled by one bit. Thus, regardless of the method used to develop signal series of the second and third type for a given rock strength, it is desirable to repeat the above process for other rock strengths which the bit in question is designed to drill. For example, for a given bit, one might develop signal series corresponding to curves such as shown in FIG. 3 for the softest rock it is anticipated the bit will drill, other signal series corresponding to curves such as shown in FIG. 4 for the hardest rock, and still other such series for intermediate rock strengths. This can provide an operator in the field with more complete information on optimizing use of the bit in question.

Then, for example, if the assay of the interval to be drilled by the bit includes strata of different rock strengths, the operation in each of these strata can be optimized. By way of further example, if the assay is based on adjacent holes, but MWD measurements indicate that rock of a different strength is, for some reason, being encountered in the hole in question, the operating conditions can be changed accordingly.

In even more highly preferred embodiments, it is possible to model $\sigma$ in real time, as it changes with relatively small increases in depth, as explained in the present inventors' copending application Ser. No. 08/621,412, entitled "Method of Assaying Compressive Strength of Rock," filed contemporaneously herewith, and incorporated herein by reference.

As previously mentioned, in order to take best advantage of the present invention, it is advisable to model the wear of the bit as it proceeds through the interval it drills, or, given available technology, measure the wear of the bit or some parameter indicative thereof in real time, so that the weight-on-bit and rotary speed can be periodically adjusted to new optimal for the current wear condition of the bit.

Some prior U.S. patents, such as U.S. Pat. No. 3,058,532, U.S. Pat. No. 2,560,328, U.S. Pat. No. 2,580,860, U.S. Pat. No. 4,785,895, U.S. Pat. No. 4,785,894, U.S. Pat. No. 4,655,300, U.S. Pat. No. 3,853,184, U.S. Pat. No. 3,363,702, and U.S. Pat. No. 2,925,251, disclose various technologies purporting to directly detect bit wear in real time.

Prior U.S. Pat. No. 5,305,836 to Holbrook discloses a technique for modeling bit wear in real time.

Figure 5:
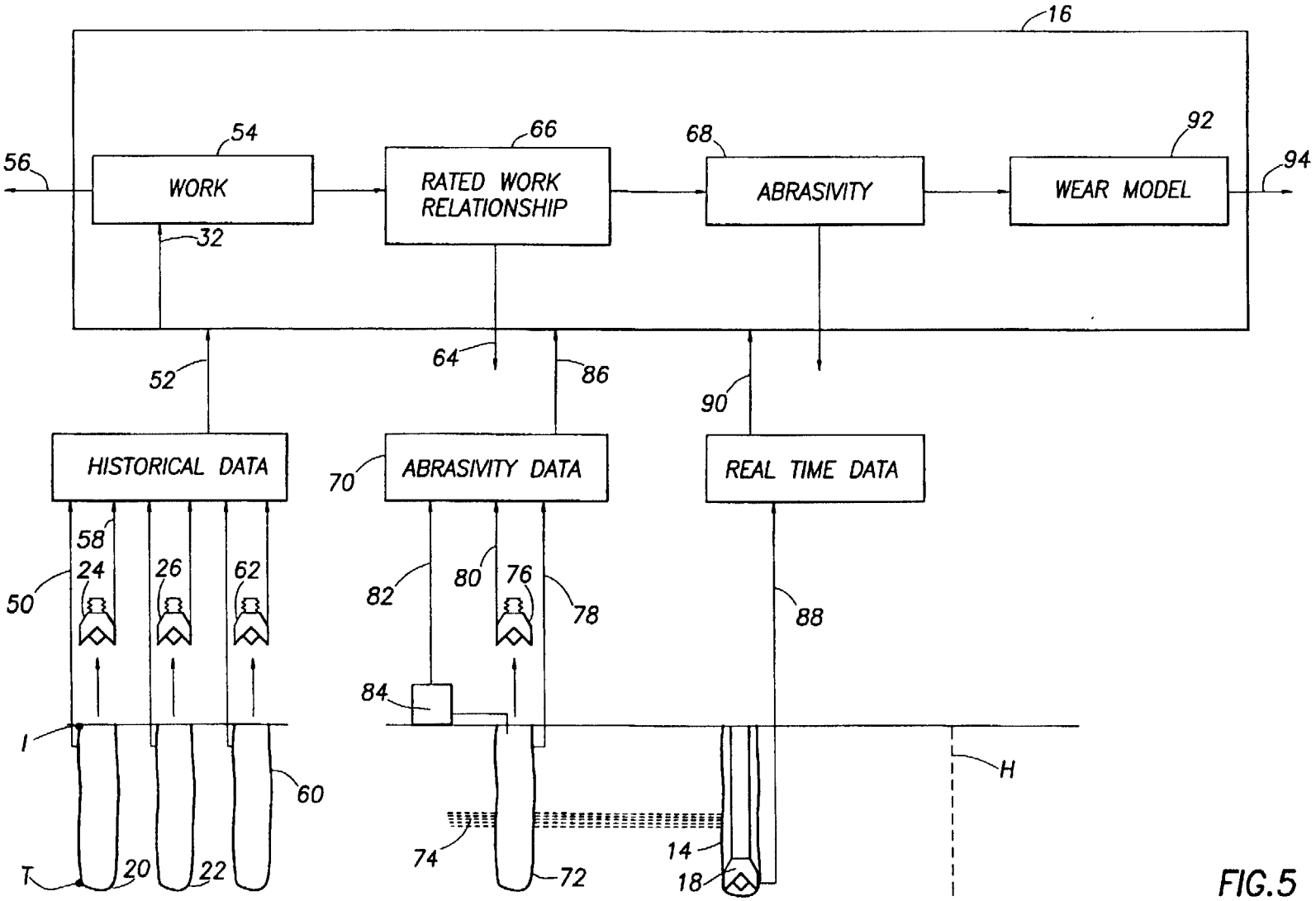
FIG. 5 is a diagram generally illustrating a wear modeling process which can be used in the present invention.

Another method of modeling bit wear is as follows:

Referring to FIG. 5, the wear modeling proceeds from assaying work of a well drilling bit such as 24 of the same size and design as bit 18. As in FIG. 1, a well bore or hole section 20 is drilled, at least partially with the bit 24. More specifically, bit 24 will have drilled the hole 20 between an initial point I and a terminal point T. In this illustrative embodiment, the initial point I is the point at which the bit 24 was first put to work in the hole 20, and the terminal point T is the point at which the bit 24 was withdrawn. However, for purposes of assaying work per se, points I and T can be any two points which can be identified, between which the bit 24 has drilled, and between which the necessary data, to be described below, can be generated.

The basic rationale is to assay the work by using the well known relationship:

$$\Omega_b = F_b D \tag{5}$$

where:

$\Omega_b$=bit work $F_b$=total force at the bit

D=distance drilled

The length of the interval of the hole 20 between points I and T can be determined and recorded as one of a number of well data which can be generated upon drilling the hole 20, as diagrammatically indicated by the line 50. To convert it into an appropriate form for inputting into and processing by the computer 36, this length, i.e. distance between points I and T, is preferably subdivided into a number of small increments of distance, e.g. of about one-half foot each. For each of these incremental distance values, a corresponding electrical incremental distance signal is generated and inputted into the computer 36, as indicated by line 52.

In order to determine the work, a plurality of electrical incremental actual force signals, each corresponding to the force of the bit over a respective increment of the distance between points I and T, are also generated. However, because of the difficulties inherent in directly determining the total bit force, signals corresponding to other parameters from the well data 50, for each increment of the distance, are inputted, as indicated at 52. These can, theoretically, be capable of determining the true total bit force, which includes the applied axial force, the torsional force, and any applied lateral force. However, unless lateral force is purposely applied (in which case it is known), i.e. unless stabilizers are absent from the bottom hole assembly, the lateral force is so negligible that it can be ignored.

In one embodiment, the well data used to generate the incremental actual force signals are:

weight on bit (w), e.g. in lb.;

hydraulic impact force of drilling fluid ($F_i$), e.g. in lb.;

rotary speed, in rpm (N);

torque (T), e.g. in ft.*lb.;

penetration rate (R), e.g. in ft./hr. and;

lateral force, if applicable ($F_l$), e.g. in lb.

With these data for each increment, respectively, converted to corresponding signals and inputted as indicated at 52, the computer 36 is programmed or configured to process those signals to generate the incremental actual force signals by performing the electronic equivalent of solving the following equation:

$$\Omega_b = [(w+F_i)+120\pi NT/R+F_l]D \tag{6}$$

where the lateral force, $F_L$, is negligible, that term, and the corresponding electrical signal, drop out.

Surprisingly, it has been found that the torsional component of the force is the most dominant and important, and in less preferred embodiments of the invention, the work assay may be performed using this component of force alone, in which case the corresponding equation becomes:

$$\Omega_b=[120\pi NT/R\ ]D \quad (7)$$

In an alternate embodiment, in generating the incremental actual force signals, the computer 36 may use the electronic equivalent of the equation:

$$\Omega_b=2\pi TD/d_c \quad (8)$$

where d represents depth of cut per revolution, and is, in turn, defined by the relationship:

$$d_c=R/60N \quad (9)$$

The computer 36 is programmed or configured to then process the incremental actual force signals and the respective incremental distance signals to produce an electrical signal corresponding to the total work done by the bit 24 in drilling between the points I and T, as indicated at block 54. This signal may be readily converted to a humanly perceivable numerical value outputted by computer 36, as indicated by the line 56, in the well known manner.

The processing of the incremental actual force signals and incremental distance signals to produce total work 54 may be done in several different ways. For example:

In one version, the computer processes the incremental actual force signals and the incremental distance signals to produce an electrical weighted average force signal corresponding to a weighted average of the force exerted by the bit between the initial and terminal points. By "weighted average" is meant that each force value corresponding to one or more of the incremental actual force signals is "weighted" by the number of distance increments at which that force applied. Then, the computer simply performs the electronic equivalent of multiplying the weighted average force by the total distance between points I and T to produce a signal corresponding to the total work value.

In another version, the respective incremental actual force signal and incremental distance signal for each increment are processed to produce a respective electrical incremental actual work signal, whereafter these incremental actual work signals are cumulated to produce an electrical total work signal corresponding to the total work value.

In still another version, the computer may develop a force versus distance function from the incremental actual force signals and incremental distance signals, and then perform the electronic equivalent of integrating that function.

Not only are the three ways of processing the signals to produce a total work signal equivalent, they are also exemplary of the kinds of alternative processes which will be considered equivalents in connection with other processes forming various parts of the present invention, and described below.

Technology is now available for determining when a bit is vibrating excessively while drilling. If it is determined that this has occurred over at least a portion of the interval between points I and T, then it may be preferable to suitably program and input computer 36 so as to produce respective incremental actual force signals for the increments in question, each of which corresponds to the average bit force for the respective increment. This may be done by using the average (mean) value for each of the variables which go into the determination of the incremental actual force signal.

Wear of a drill bit is functionally related to the cumulative work done by the bit. In addition to determining the work done by bit 24 in drilling between points I and T, the wear of the bit 24 in drilling that interval is measured. A corresponding electrical signal is generated and inputted into the computer as part of the historical data 58, 52. (Thus, for this purpose, point I should be the point the bit 24 is first put to work in the hole 20, and point T should be the point at which bit 24 is removed.) The same may be done for additional holes 22 and 60, and their respective bits 26 and 62.

Figure 6:
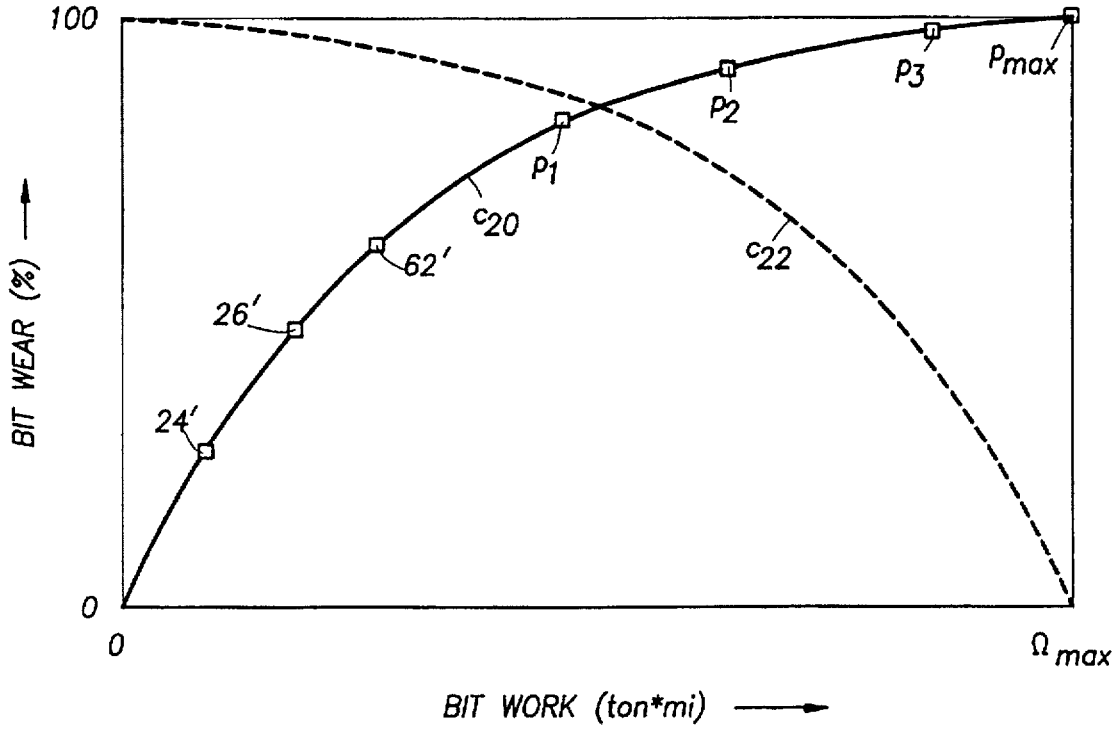
FIG. 6 is a graphic illustration of the rated work relationship.

FIG. 6 is a graphic representation of what the computer 36 can do, electronically, with the signals corresponding to such data. FIG. 6 represents a graph of bit wear versus work. Using the aforementioned data, the computer 36 can process the corresponding signals to correlate respective work and wear signals and perform the electronic equivalent of locating a point on this graph for each of the holes 20, 22 and 60, and its respective bit. For example, point 24' may represent the correlated work and wear for the bit 24, point 26' may represent the correlated work and wear for the bit 26, and point 62' may represent the correlated work and wear for the bit 62. Other points $p_1$, $p_2$ and $p_3$ represent the work and wear for still other bits of the same design and size not shown in FIG. 5.

By processing the signals corresponding to these points, the computer 36 can generate a function, defined by suitable electrical signals, which function, when graphically represented, takes the form of a smooth curve generally of the form of curve $c_{20}$ it will be appreciated, that in the interest of generating a smooth and continuous curve, such curve may not pass precisely through all of the individual points corresponding to specific empirical data. This continuous "rated work relationship" can be an output 64 in its own right, and can also be used in the wear modeling.

It is helpful to determine an end point $p_{max}$ which represents the maximum bit wear which can be endured before the bit is no longer realistically useful and, from the rated work relationship, determining the corresponding amount of work. Thus, the point $p_{max}$ represents a maximum-wear-maximum-workpoint, sometimes referred to herein as the "work rating" of the type of bit in question. It may also be helpful to develop a relationship represented by the mirror image of curve $c_{20}$, i.e. curve $c_{22}$, which plots remaining useful bit life versus work done from the aforementioned signals.

The electrical signals in the computer which correspond to the functions represented by the curves $c_{20}$ and $c_{22}$ are preferably transformed into a visually perceptible form, such as the curves as shown in FIG. 6, when outputted at 64.

As mentioned above in another context, bit vibrations may cause the bit force to vary significantly over individual increments. In developing the rated work relationship, it is preferable in such cases, to generate a respective peak force signal corresponding to the maximum force of the bit over each such increment. A limit corresponding to the maximum allowable force for the rock strength of that increment can also be determined as explained below. For any such bit which is potentially considered for use in developing the curve $c_1$, a value corresponding to the peak force signal should be compared to the limit, and if that value is greater than or equal to the limit, the respective bit should be excluded from those from which the rated work relationship signals are generated. This comparison can, of course, be done electronically by computer 36, utilizing an electrical limit signal corresponding to the aforementioned limit.

The rationale for determining the aforementioned limit is based on the power limit explained above in connection with FIG. 2. Once the limiting power for the appropriate rock strength is thus determined, the corresponding maximum force limit may be extrapolated by simply dividing this power by the rate of penetration.

Alternatively, the actual bit power could be compared directly to the power limit.

In either case, the process may be done electronically by computer 36.

Other factors can also affect the intensity of the vibrations, and these may also be taken into account in preferred embodiments. Such other factors include drill string geometry and rigidity, hole geometry, and the mass of the bottom hole assembly below the neutral point in the drill string.

The manner of generating the peak force signal may be the same as that described above in generating incremental actual force signals for increments in which there is no vibration problem, i.e. using the electronic equivalents of equations (5), (6), or (7)+(8), except that for each of the variables, e.g. w, the maximum or peak value of that variable for the interval in question will be used (but for R, for which the minimum value should be used).

The rated work relationship 66 may be used in developing information on abrasivity, as indicated at 68. Abrasivity, in turn, can be used to enhance the wear modeling and/or to adjust the power limit. Specifically, if abrasivity is detected, the power limit should be lowered for that section of the interval being drilled.

As for the abrasivity per se, it is necessary to have additional historical data, more specifically abrasivity data 70, from an additional well or hole 72 which has been drilled through an abrasive stratum such as "hard stringer" 74, and the bit 76 which drilled the interval including hard stringer 74.

It should be noted that, as used herein, a statement that a portion of the formation is "abrasive" means that the rock in question is relatively abrasive, e.g. quartz or sandstone, by way of comparison to shale. Rock abrasivity is essentially a function of the rock surface configuration and the rock strength. The configuration factor is not necessarily related to grain size, but rather than to grain angularity or "sharpness."

Turning again to FIG. 5, the abrasivity data 70 include the same type of data 78 from the well 72 as data 50, i.e. those well data necessary to determine work, as well as a wear measurement 80 for the bit 76. In addition, the abrasivity data include the volume 82 of abrasive medium 74 drilled by bit 78. The latter can be determined in a known manner by analysis of well logs from hole 72, as generally indicated by the black box 84.

As with other aspects of this invention, the data are converted into respective electrical signals inputted into the computer 36 as indicated at 86. The computer 16 quantifies abrasivity by processing the signals to perform the electronic equivalent of solving the equation:

$$\lambda=(\Omega_{rated}-\Omega_b)/V_{abr} \tag{10}$$

where:

$\lambda$=abrasivity $\Omega_b$=actual bit work (for amount of wear of bit 56)

$\Omega_{rated}$=rated work (for the same amount of wear)

$V_{abr}$=volume of abrasive medium drilled

Figure 7:
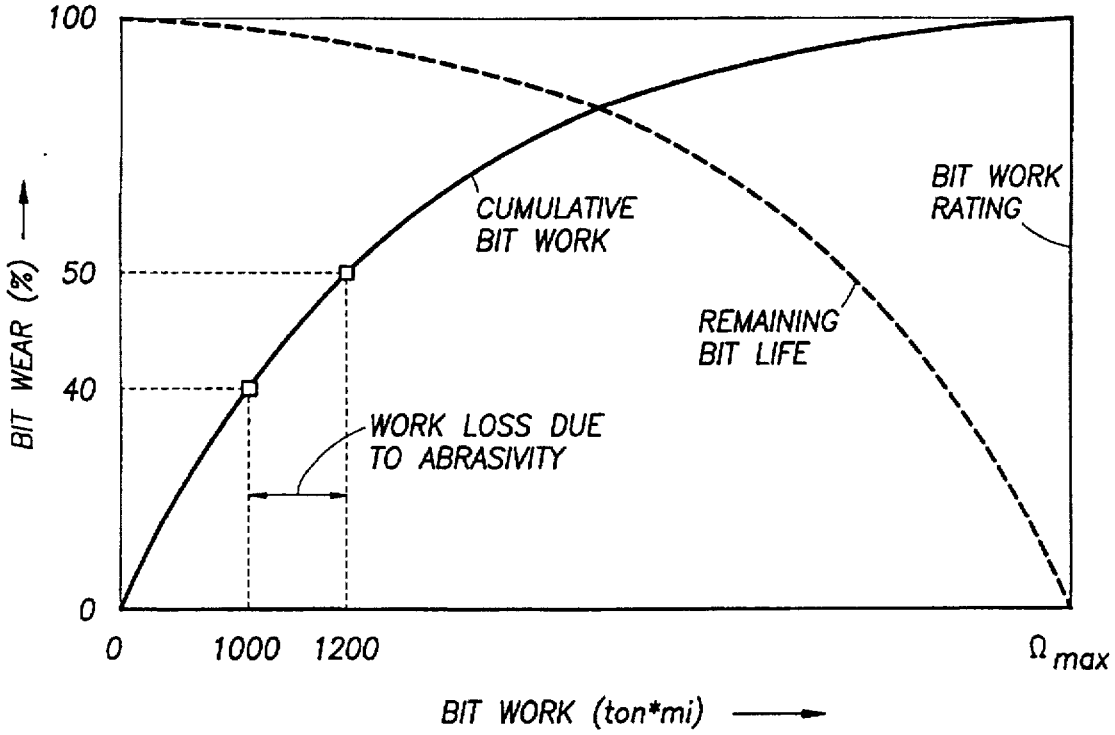
FIG. 7 is a graphic illustration of work loss due to formation abrasivity.

For instance, suppose that a bit has done 1,000 ton-miles of work and is pulled with 50% wear after drilling 200 cubic feet of abrasive medium. Suppose also that the historical rated work relationship for that particular bit indicates that the wear should be only 40% at 1,000 ton-miles and 50% at 1,200 ton-miles of work as indicated in FIG. 7. In other words, the extra 10% of abrasive wear corresponds to an additional 200 ton-miles of work. Abrasivity is quantified as a reduction in bit life of 200 ton-miles per 200 cubic feet of abrasive medium drilled or 1 (ton*mile/ft$^3$). This unit of measure is dimensionally equivalent to laboratory abrasivity tests. The volume percent of abrasive medium can be determined from well logs that quantify lithologic component fractions. The volume of abrasive medium drilled may be determined by multiplying the total volume of rock drilled by the volume fraction of the abrasive component. Alternatively, the lithological data may be taken from logs from hole 72 by measurement while drilling techniques as indicated by black box 84.

The rated work relationship 66 and, if appropriate, the abrasivity 68, can further be used to remotely model the wear of the bit 18 as it drills a hole 14. In the exemplary embodiment illustrated in FIG. 5, the interval of hole 14 drilled by bit 18 extends from the surface through and beyond the hard stringer 74.

Using measurement while drilling techniques, and other available technology, the type of data generated at 50 can be generated on a current basis for the well 14 as indicated at 88. Because this data is generated on a current basis, it is refered to herein as "real time data." The real time data is converted into respective electrical signals inputted into computer 36 as indicated at 90. Using the same process as for the historical data, i.e. the process indicated at 54, the computer can generate incremental actual force signals and corresponding incremental distance signals for every increment drilled by bit 18. Further, the computer can process the incremental actual force signals and the incremental distance signals for bit 18 to produce a respective electrical incremental actual work signal for each increment drilled by bit 18, and periodically cumulate these incremental actual work signals. This in turn produces an electrical current work signal corresponding to the work which has currently been done by bit 18. Then, using the signals corresponding to the rated work relationship 66, the computer can periodically transform the current work signal to an electrical current wear signal indicative of the wear on the bit in use, i.e. bit 18.

These basic steps would be performed even if the bit 68 was not believed to be drilling through hard stringer 54 or other abrasive stratum. Preferably, when the current wear signal reaches a predetermined limit, corresponding to a value at or below the work rating for the size and design bit in question, bit 68 is retrieved.

Because well 70 is near well 52, and it is therefore logical to conclude that bit 68 is drilling through hard stringer 54, the abrasivity signal produced at 48 is processed to adjust the current wear signal produced at 74 as explained in the abrasivity example above.

Once again, it may also be helpful to monitor for excessive vibrations of the bit 18 in use. If such vibrations are detected, a respective peak force signal should be generated, as described above, for each respective increment in which such excessive vibrations are experienced. Again, a limit corresponding to the maximum allowable force for the rock strength of each of these increments is also determined and a corresponding signal generated. Computer 36 electronically compares each such peak force signal to the respective limit signal to assay possible wear in excess of that corresponding to the current wear signal. Remedial action can be taken. For example, one may reduce the operating power level, i.e. the weight on bit and/or rotary speed.

In any case, the current wear signal 92 is preferably outputted in some type of visually perceptible form as indicated at 94.

The above example illustrates a wear time real modeling process. It should be understood that a predictive wear model could be produced in advance, using similar electronic processing methodology, but operating on the assumption that the lithology which will be drilled by bit 18 is identical to that which has been drilled by bit 76. Then, the aforementioned adjustments of weight-on-bit and rotary speed, to account for bit wear, could be based on this predictive model. In a highly preferred embodiment, an advance predictive model would be provided, but real time wear modeling would also be done, to verify and/or adjust the advance predictive model, and the corresponding rotary speed and weight-on-bit adjustments.

Numerous modifications to the foregoing embodiments will suggest themselves to those of skill in the art. Accordingly, it is intended that the scope of the present invention be limited only by the claims which follow.

What is claimed is:

1. A method of regulating drilling conditions applied to a given well bit, comprising the steps of:

assaying the compressive strength of the formation in an interval to be drilled by said bit;

analyzing wear of critical bit structure of the same size and design as in said given bit and which structure has drilled material of approximately the same compressive strength as that so assayed, along with respective drilling data for the worn structure;

from said analysis determining a power limit for the respective compressive strength, above which power limit undesirable bit wear is likely to occur; and regulating drilling conditions at which said given bit is operated to maintain a desired operating power less than or equal to said power limit.

2. The method of claim 1 wherein a plurality of such structures and respective drilling data are so analyzed;

further comprising generating from said analyses a first type series of correlated pairs of electrical signals, the two signals of each such pair corresponding, respectively, to wear rate and operating power for a respective one of said structures;

and wherein said power limit is generated from said signals of said first type series.

3. The method of claim 2 wherein at least one of said structures is a separate part of a size and design used in said given bit and is so analyzed under laboratory conditions.

4. The method of claim 2 wherein at least one of said structures is a complete bit of the same size and design as said given bit and is so worn in field drilling.

5. The method of claim 2 wherein said drilling conditions are so regulated to maintain said desired operating power less than but about as close as reasonably possible to said power limit.

6. The method of claim 2 wherein: said drilling conditions include conditions applied to said given bit; bit vibrations cause forces transmitted to the formation by the bit to vary over small increments of said interval; and the applied conditions are so regulated with reference to the peak transmitted forces.

7. The method of claim 2 wherein the conditions so regulated are rotary speed and weight-on-bit.

8. The method of claim 7 further comprising generating a second type series of correlated pairs of electrical signals, the respective signals of each pair corresponding to a rotary speed value and a weight-on-bit value, wherein the rotary speed and weight-on-bit values of each pair theoretically result in a power corresponding to the power limit;

and wherein said bit is operated at a rotary speed and weight-on-bit corresponding to one of said pairs of signals in said second type series.

9. The method of claim 8 further comprising determining a rotary speed limit for said power limit above which substantially disadvantageous bit movement characteristics are likely to occur, and so operating said bit at a rotary speed below said rotary speed limit.

10. The method of claim 9 further comprising determining a weight-on-bit limit for said power limit above which substantially disadvantageous bit movement characteristics are likely to occur, and so operating said bit at a weight-on-bit below said weight-on-bit limit.

11. The method of claim 10 further comprising:

determining a marginal rotary speed for said power limit, less than said rotary speed limit, above which undesirable bit movement characteristics are likely to occur;

determining a marginal weight-on-bit for said power limit, less than said weight-on-bit limit, above which undesirable bit movement characteristics are likely to occur;

and so operating said bit at a rotary speed less than or equal to said marginal rotary speed, and at a weight-on-bit less than or equal to said marginal weight-on-bit.

12. The method of claim 11 further comprising so operating said bit at such rotary speed and weight-on-bit about as close as reasonably possible to said marginal weight-on-bit.

13. The method of claim 12 further comprising determining a weight-on-bit and rotary speed combination at which a maximum depth of cut is achieved; and operating said bit at a weight-on-bit close or equal to the lesser of the weight-on-bit corresponding to said maximum depth of cut or the marginal weight-on-bit.

14. The method of claim 10 further comprising:

determining a marginal rotary speed for said power limit, less than said rotary speed limit, above which undesirable bit movement characteristics are likely to occur;

determining a marginal weight-on-bit for said power limit, less than said weight-on-bit limit, above which undesirable bit movement characteristics are likely to occur;

determining a weight-on-bit for said power limit which produces a maximum depth of cut for the bit;

and so operating said bit at a rotary speed less than or equal to said marginal rotary speed, and at a weight-on-bit close or equal to the lesser of said marginal weight-on-bit and said weight-on-bit for the maximum depth of cut.

15. The method of claim 8 further comprising determining a weight-on-bit limit for said power limit above which substantially disadvantageous bit movement characteristics are likely to occur, and so operating said bit at a weight-on-bit below said weight-on-bit limit.

16. The method of claim 8 further comprising so generating a plurality of signal series of the second type, each for a different amount of wear, and periodically increasing the weight-on-bit as said bit wears in accord with the appropriate series of the second type.

17. The method of claim 16 further comprising altering the rotary speed as the weight-on-bit is so increased.

18. The method of claim 17 further comprising measuring or modeling wear of said bit in real time.

19. The method of claim 8 wherein said compressive strength assay includes a plurality of formation layers of different compressive strengths, and further comprising:

so generating respective such first and second type series of signals for each such compressive strength;

monitoring the progress of said bit through the formation;

and periodically altering the operation of said bit in accord with the respective series of signals for the compressive strength of the formation currently being drilled by said bit.

20. The method of claim 1 wherein said compressive strength is so assayed by modeling in real time while drilling said interval with said bit.

* * * * *